US007383635B1

(12) United States Patent
Stoneberg

(10) Patent No.: US 7,383,635 B1
(45) Date of Patent: Jun. 10, 2008

(54) MULTIPURPOSE DRAWING TOOL

(75) Inventor: J. Bruce Stoneberg, Oak Brook, IL (US)

(73) Assignee: Learning Resources, Inc., Vernon Hills, IL (US)

( * ) Notice: Subject to any disclaimer, the term of this patent is extended or adjusted under 35 U.S.C. 154(b) by 0 days.

(21) Appl. No.: 11/657,177

(22) Filed: Jan. 23, 2007

(51) Int. Cl.
*B43L 9/04* (2006.01)
*B43L 7/08* (2006.01)

(52) U.S. Cl. ..... 33/27.03; 33/347

(58) Field of Classification Search ..... 33/27.03, 33/347

See application file for complete search history.

(56) References Cited

U.S. PATENT DOCUMENTS

| | | | | |
|---|---|---|---|---|
| 2,561 | A | 4/1842 | Card | |
| 165,519 | A | 7/1875 | Swasey | |
| 392,143 | A | 10/1888 | Wright | |
| 563,510 | A | 7/1896 | Savidge | |
| 570,977 | A | 11/1896 | Belcher | |
| 774,365 | A | 11/1904 | Phenix | |
| 824,299 | A | 6/1906 | Huey | |
| 1,001,229 | A | 8/1911 | Stuart et al. | |
| 1,327,154 | A | 1/1920 | Golden | |
| 1,447,207 | A | 3/1923 | Golden | |
| 1,498,485 | A | 6/1924 | Schmidtke | |
| 1,576,800 | A | 3/1926 | Tibony | |
| 1,825,266 | A | 9/1931 | Fischer | |
| 1,877,341 | A | 9/1932 | Kurtz, Jr. | |
| 2,054,420 | A | 9/1936 | Hochman | |
| 2,104,515 | A * | 1/1938 | Golden | 33/479 |
| D135,282 | S | 3/1943 | Green | |
| D142,051 | S | 8/1945 | White | |
| 2,507,073 | A | 5/1950 | White | |
| 2,537,058 | A * | 1/1951 | Jamison et al. | 33/27.02 |
| 2,537,473 | A | 1/1951 | McCusker | |
| 2,554,099 | A | 5/1951 | Ermold | |
| 2,612,690 | A | 10/1952 | Cotton | |
| 2,614,329 | A | 10/1952 | Almorth | |

(Continued)

FOREIGN PATENT DOCUMENTS

DE 4244533 A1 5/1993

OTHER PUBLICATIONS

*Demonstrations of A+ Compass*, A+ Compass™, http://www.apluscompass.com/demos.htm, retrieved on Jun. 20, 2006.

*Primary Examiner*—Christopher W Fulton
(74) *Attorney, Agent, or Firm*—Drinker Biddle & Reath LLP

(57) ABSTRACT

A multipurpose drawing tool is provided. One embodiment of the tool that is advantageous for drawing circles one-handedly includes a protractor portion and an elongated radius arm portion. The protractor portion includes an aperture, and a securing member is rotatably mounted in the aperture. The securing member may be a transparent or translucent suction cup for releasably attaching the tool to a drawing surface such as a vertically-oriented dry-erase or chalk board. Alternatively, the securing member may be a transparent or translucent magnet or a conventional magnet configured with a generally annular or toroidal shape. In another embodiment, an improved protractor is provided that includes a straightedge portion, a semicircular portion, a pivot arm and a suction cup or magnet securing member that pivotally secures an end of the arm to a central portion of the straightedge portion.

11 Claims, 6 Drawing Sheets

U.S. PATENT DOCUMENTS 2,722,055 A 11/1955 Rader
2,781,582 A * 2/1957 Wursch ..... 33/27.03
2,857,674 A 10/1958 Feldhake
3,015,889 A 1/1962 Godman
3,111,761 A * 11/1963 McAlister, Jr. ..... 33/27.03
3,263,334 A 8/1966 Mutter
3,292,262 A * 12/1966 Moll ..... 33/27.03
3,378,927 A * 4/1968 Lowery ..... 33/26
3,474,538 A 10/1969 Kirkegaard
3,791,036 A 2/1974 Stober, Jr. et al.
4,267,638 A 5/1981 Heinz
4,353,166 A 10/1982 Kettlestrings
4,821,424 A 4/1989 Loggins
5,090,127 A 2/1992 Shapiro et al.
5,113,590 A 5/1992 Shapiro et al.
5,193,284 A 3/1993 Lin
5,240,338 A 8/1993 Jye
5,426,859 A 6/1995 Concari et al.
5,497,558 A * 3/1996 Wagner ..... 33/27.03
5,615,485 A 4/1997 Stoneberg
D411,959 S 7/1999 Chan
D412,717 S 8/1999 Urness
5,987,760 A 11/1999 Hsu
D418,868 S 1/2000 Urness
6,286,216 B1 9/2001 Braun
6,405,443 B1 6/2002 Thorn et al.
6,427,344 B1 8/2002 Smith et al.
6,606,796 B2 8/2003 Stoneberg
D502,115 S 2/2005 Chudek et al.
6,978,550 B2 * 12/2005 Xieh ..... 33/27.02

* cited by examiner

MULTIPURPOSE DRAWING TOOL

FIELD OF THE INVENTION

This invention relates to drawing tools and, more particularly, to multipurpose drawing and measuring tools that enable a user thereof to manipulate the tools one-handedly on a drawing surface such as, for example, a vertically-oriented dry-erase or chalk board.

BACKGROUND OF THE INVENTION

There are numerous well-known drawing tools available for drawing circles, drawing and measuring lines, constructing and measuring angles, and producing geometric constructions and patterns. Generally, these devices do not provide clearly visible, direct views of vertex points through an open pivot point for drawing circles, constructing and measuring angles, and producing geometric constructions and patterns. Rather, the user must approximate the positioning of the device over the vertex point, impairing the accuracy of the positioning of circles drawn with the device, or the accuracy of the construction and measurement of angles.

One device for drawing circles that provides a clear view of vertex points through a pivot point is disclosed in U.S. Pat. No. 6,606,792, issued Aug. 13, 2003 to Stoneberg for "Drawing Tool." The disclosed drawing tool includes a protractor portion at one end and an elongated radius arm portion extending therefrom, with a pivot disc rotatably mounted in the tool proximate the protractor portion. The radius arm rotates about the pivot disc that includes an open circular pivot point for sighting a vertex point. Although this drawing tool has enjoyed substantial commercial success, use of the tool has been somewhat limited to drawing and measuring on horizontal surfaces such as desks, overhead projectors and the like because a user must continuously press down on the pivot disc when drawing a circle to keep the tool aligned with the vertex point.

Due to the ubiquity of drawing surfaces such as, for example, vertically-oriented dry-erase or "white" boards, vertically-oriented chalk or "black" boards and horizontal surfaces such as overhead projectors and the like, in educational/classroom and workplace settings, an improved drawing tool that facilitates drawing circles in a one-handed manner would be an important improvement in the art.

BRIEF SUMMARY OF THE INVENTION

In one embodiment, an improved multipurpose drawing tool is provided for one-handed drawing of circles on a drawing surface. The improved drawing tool includes a protractor portion at one end and an elongated radius arm portion at the other end. The elongated radius arm portion includes an elongated cavity, and an adjustable radius indicator is mounted in the elongated cavity for movement along the elongated radius arm portion. The protractor portion includes an aperture, and a securing member is rotatably mounted in the aperture. The securing member may be a transparent or translucent suction cup for releasably attaching the tool to a drawing surface such as a vertically-oriented dry-erase board or chalk board. The securing member may alternatively be a transparent or translucent magnet or a conventional magnet configured with a generally annular or toroidal shape so that a vertex point can be sighted therethrough. In another embodiment, an improved protractor is provided for constructing and measuring angles and arcs.

The improved protractor includes a straightedge portion, a semicircular portion and a pivot arm that is pivotally secured at one end to a central portion of the straightedge portion by a securing member that is substantially similar to the securing member of the first embodiment.

DETAILED DESCRIPTION OF THE EMBODIMENTS

Figure 1:
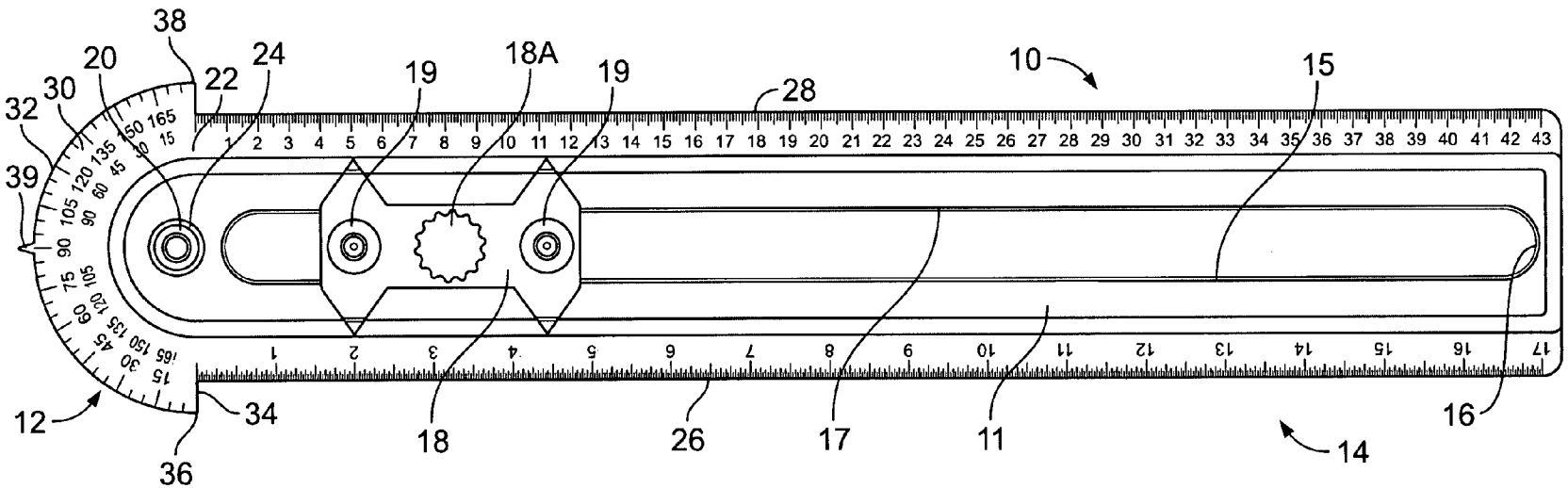
FIG. 1 illustrates a top plan view of a first embodiment of a multi-purpose drawing tool.

Referring now to the Figures, an improved multipurpose drawing tool is provided. As shown in FIG. 1, a first embodiment of an improved multipurpose drawing tool 10 includes a body 11 having a protractor portion 12 at its proximal end, and an elongated radius arm portion 14 at its distal end. The body 11 of the tool 10 may be made from a clear or opaque plastic. Additionally, the plastic may be shatter-resistant, for durability and safety reasons.

An elongated rectangular cavity 16 having opposite edges 15 and 17 is centered on the longitudinal axis of the radius arm portion 14 and substantially co-extensive therewith. An adjustable radius indicator 18 is mounted for sliding motion in cavity 16 along substantially the entire length of the radius arm portion 14. As shown, the adjustable radius indicator includes a knob 18A that can be tightened and loosened to respectively secure and adjust the indicator 18 on the radius arm portion 14. As further shown, the adjustable radius indicator 18 includes apertures 19 that are configured to receive one or more writing implements such as, for example markers, chalk, pencils, pens, etc. A securing member 20 is rotatably mounted adjacent the proximal end of the tool 10, bridging the intersection 22 of the protractor portion 12 and the radius arm portion 14. As shown, a bore or aperture 24 is formed adjacent the proximal end of the tool 10 and is configured to receive the securing member 20. Furthermore, the aperture 24 is coaxial with the center of a circle defined by the generally half-moon shaped protractor portion 12.

Figure 1A:
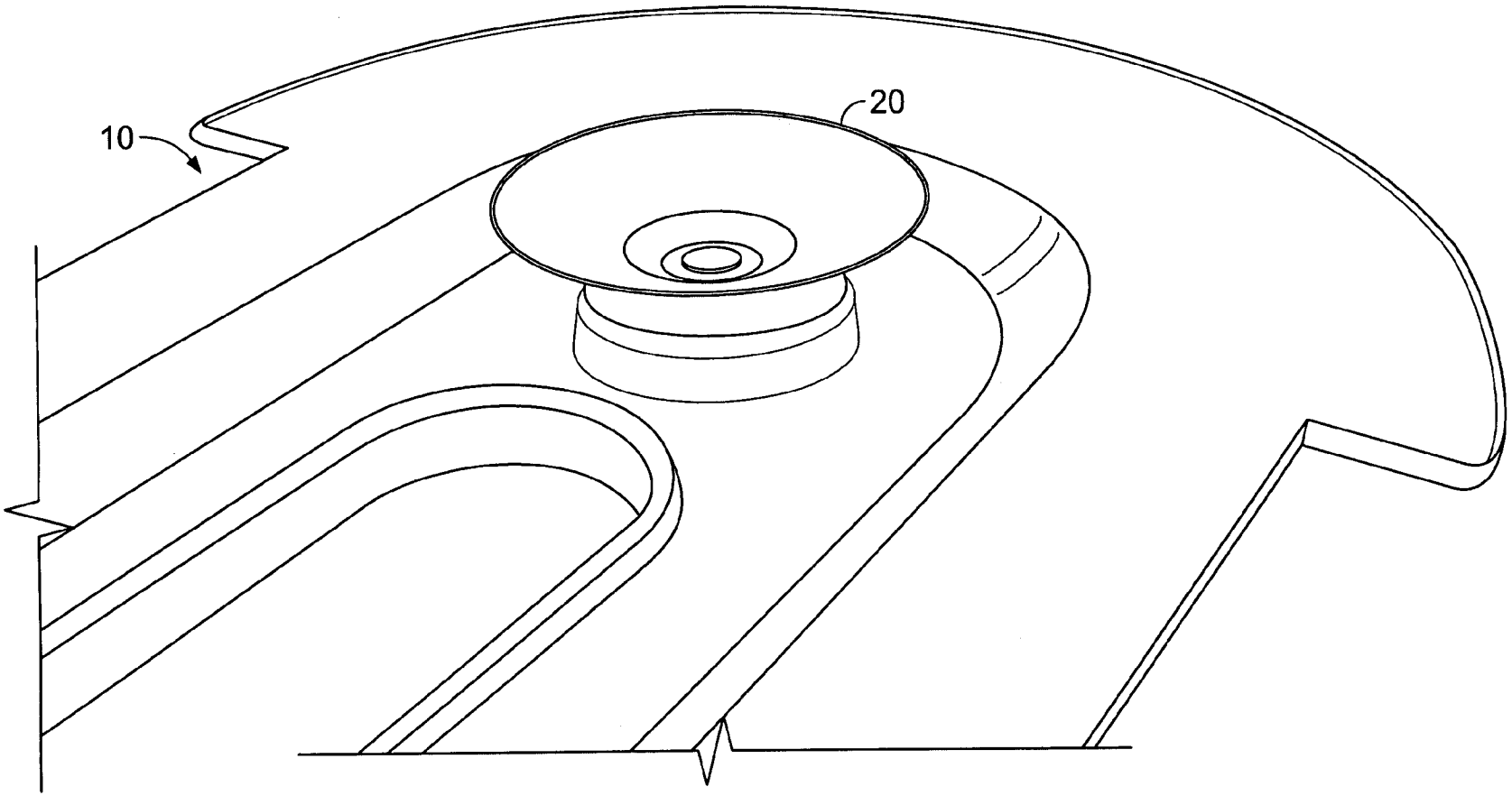
FIG. 1A illustrates a close-up, rear perspective partial view of the embodiment of FIG. 1.

As best illustrated in FIG. 1A, the securing member 20 may be a suction cup for releasably attaching the tool 10 to a surface, for example a vertically-oriented surface S (FIG. 3) such as a dry-erase marker board (also known in the art as a "whiteboard") or a chalkboard (also known in the art as a "blackboard"). Although the securing member 20 is particularly advantageous for releasably attaching the tool 10 to vertically-oriented surfaces, the securing member 20 is not limited to such use and may be used to releasably attach the tool 10 to horizontal surfaces and other slanted or angled surfaces. Furthermore, although the illustrated embodiment of the tool 10 is shown with the securing member 20 being a suction cup, the securing member 20 may alternatively be a magnet. The securing member 20 will be described in more detail hereinafter.

Figure 2:
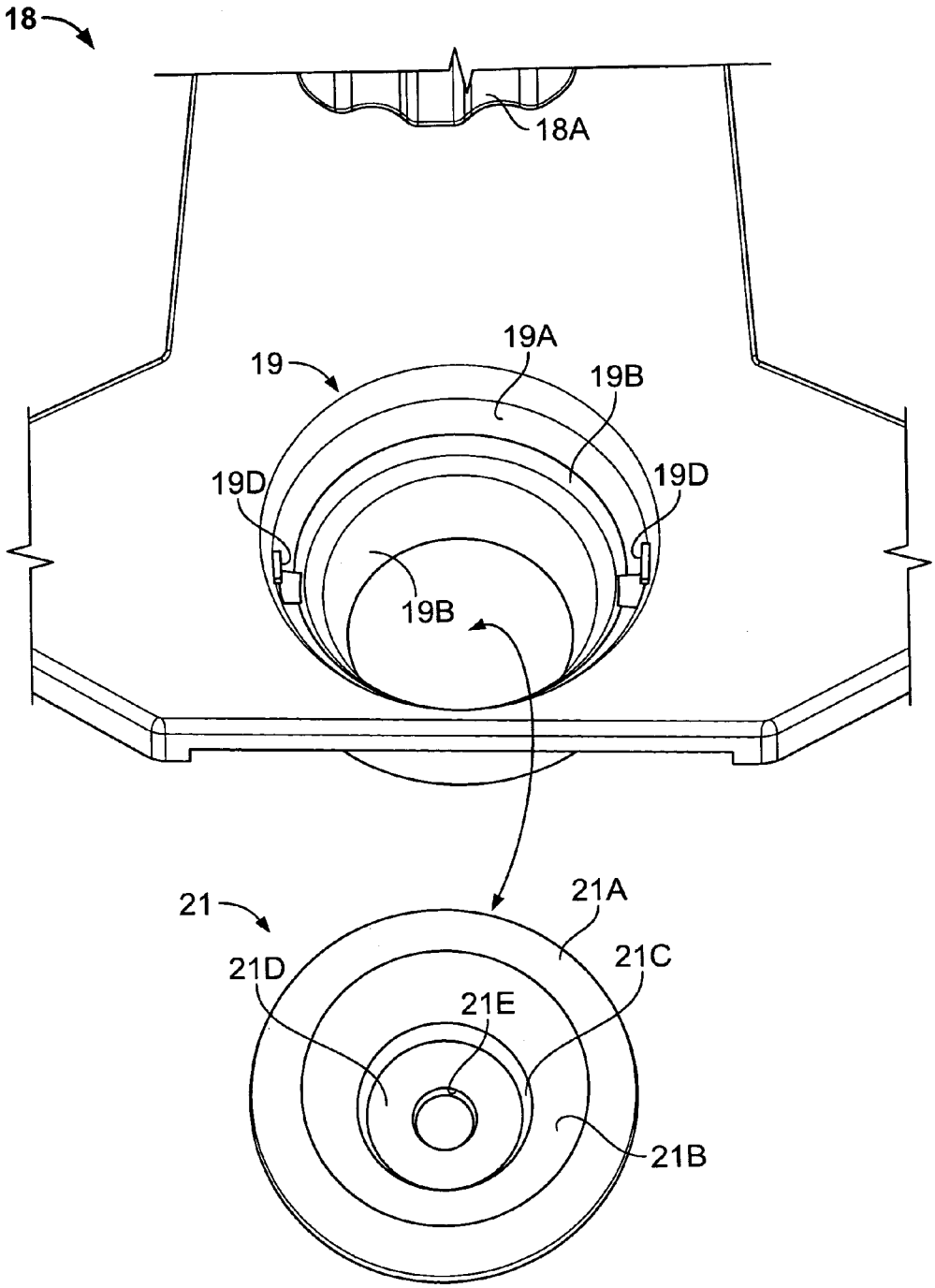
FIG. 2 illustrates a partial top, disassembled view of an example adjustable radius indicator for the embodiment of FIG. 1.

To facilitate use of the tool 10 with various writing implements (e.g., having various thicknesses), in some embodiments of the tool 10, the adjustable radius indicator 18 may include one or more apertures 19 with removable insert members 21 as shown in FIG. 2. In some embodiments of the tool 10, the members 21 are formed or molded separately from the adjustable radius indicator 18. However, in other embodiments of the tool 10, the members 21 are integrally or unitarily formed or molded with the adjustable radius indicator 18 such that the members 21 are connected with the apertures 19 by a frangible web or connection. As shown, an example aperture 19 may include an upper portion 19A, a lower portion 19B, a ledge 19C and engagement tabs 19D. The upper portion 19A may extend downwardly, generally perpendicularly from a generally planar top surface of the adjustable radius indicator 18 so that the upper portion 19A is generally cylindrical in shape. As can be appreciated, the upper portion 19A may be shaped otherwise, for example, elliptically, triangularly, rectangularly, etc. relative to the configuration of the removable member 21. The upper portion 19A terminates at the ledge 19C a predetermined distance below the generally planar top surface of the adjustable radius indicator 18.

The ledge 19C extends circumferentially inward from the bottom of the upper portion 19A so that the lower portion 19B, which is also generally cylindrical in shape, extends downwardly from the ledge 19C and has a diameter that is smaller than a diameter of the upper portion 19A. In this way, the illustrated aperture 19 has a stepped cylindrical configuration, however, the aperture 19 may alternatively have a generally conical or frustoconical configuration. The engagement tabs 19D are configured on the upper portion 19A above the ledge 19C and extend radially inward. Although two engagement tabs 19D are shown in the illustrated aperture 19 as being diametrically opposed, fewer or additional engagement tabs 19D may be provided and configured as desired.

Figure 3:
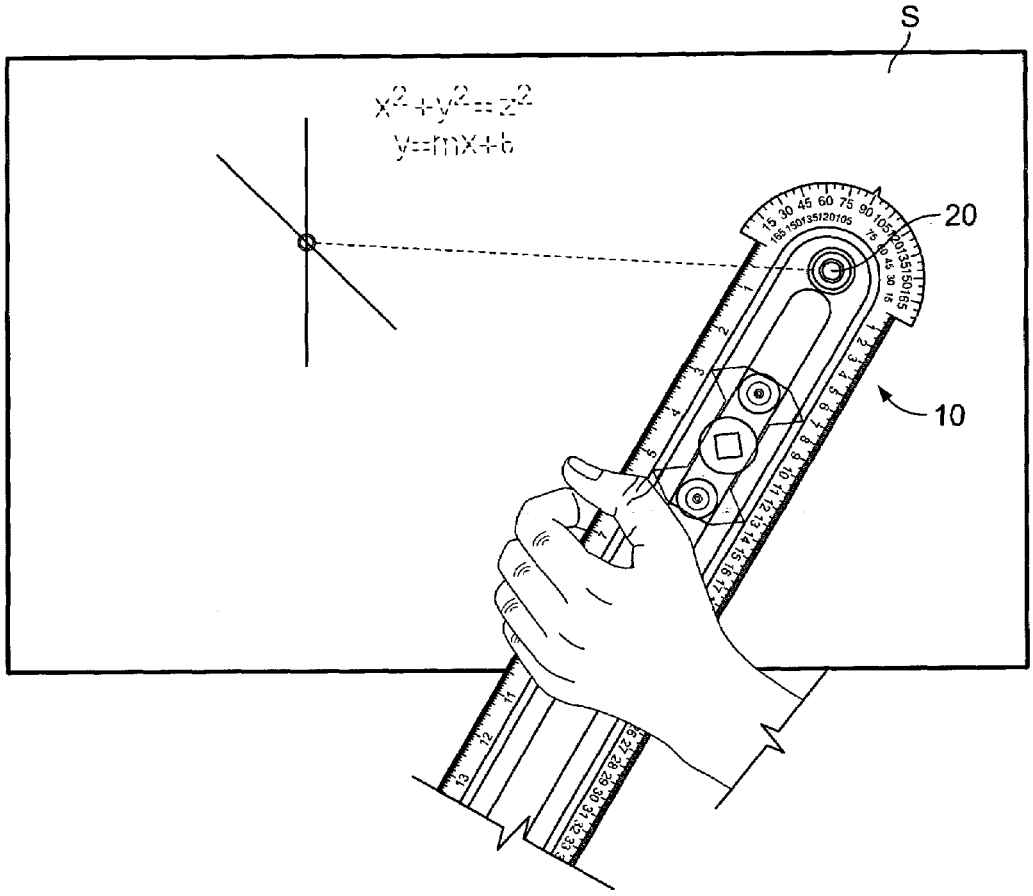
FIG. 3 illustrates the embodiment of FIG. 1 being attached to a vertical drawing surface.

The removable member 21, which has a complementary shape to the aperture 19, is configured for insertion and removal from the aperture 19. As shown, the removable member 21 includes an upper flange portion 21A, a frustoconical wall portion 21B, a cylindrical wall portion 21C and a floor portion 21D with a hole 21E. As shown, the upper flange portion 21A is generally annular in shape and has an outer diameter that is substantially similar to the inner diameter of the upper portion 19A of aperture 19. As can be appreciated, upon inserting the member 21 in the aperture 19 and pressing the member 21 home, the flange portion 21A moves past the engagement tabs 19D and comes to rest on the ledge 19C of the aperture 19. When the member 21 is pressed home in the aperture 19, the floor portion 21D is generally coplanar with or slightly above a bottom surface of lower portion 19B so that a writing implement can contact a drawing surface S (FIG. 3). Engagement tabs 19D are configured to resiliently move radially outward and inward to act as a pawl and interference couple the member 21 with the aperture 19 when the flange portion 21A moves past the tabs 19D. In this way, the member 21 can be removed from the aperture 19 by applying a force to the floor portion 21D while accidental removal of the member 21 is prevented. Additionally, the flange portion 21A may be generally planar and may have a thickness that generally corresponds with the distance between the ledge 19C and the engagement tabs 19D so that the member 21 does not substantially move in the aperture 19 once the flange portion 21A is engaged by tabs 19D. In the illustrated embodiment, although the member 21 is releasably retained in the aperture 19 by the tabs 19D, other suitable retaining or engaging means, devices and structures that are known in the art (e.g., friction fit, double-side tape, glue, hook and loop fasteners, etc.) may be substituted. Furthermore, although not illustrated, the member 21 may be attached to the aperture 19 or other portion of the tool 10 (e.g., the adjustable radius indicator 18) to prevent accidental loss or misplacement of the member 21. For example, the member 21 may be attached to the generally planar top surface of the adjustable radius indicator 18 by string, web or other tethering member.

As further shown, the frustoconical wall portion 21B extends downwardly and inwardly from the inner diameter of the flange portion 21A to terminate at the upper end of cylindrical wall portion 21C. The cylindrical wall portion 21C extends downwardly from the frustoconical wall portion 21B and terminates in floor portion 21D. A hole 21E is configured in floor portion 21D so that a tip (or portion thereof) of a writing implement can contact a drawing surface S (FIG. 3). Although the member 21 is shown and described as being generally bowl-shaped with the frustoconical wall portion 21B, the cylindrical wall portion 21C and the floor portion 21D, the member 21 may be configured otherwise (e.g., with fewer or additional wall portions) as desired.

As can be appreciated, by removing the members 21 from apertures 19, the tool 10 may be used with or otherwise configured to accept writing implements that have large tips (e.g., sticks of chalk, chisel tip dry-erase markers, etc.) so that the user can draw thick curves, arcs, etc. Furthermore, by disposing the members 21 in apertures 19, the tool 10 may be used with or otherwise configured to accept various small-tipped writing implements so that the user can draw thin curves, arcs, etc. For example, by inserting a small-tipped writing implement (e.g., pens, pencils, bullet tip or fine tip dry-erase markers, etc.) in the member 21, a user may draw fine curves, arcs, etc. with the tool 10 since the tip of the writing implement is confined in hole 21E as the tool 10 moves on the drawing surface S.

Referring back to FIG. 1, protractor portion 12 projects laterally (i.e., perpendicular to the longitudinal axis of the radius arm portion 14) beyond the lateral edges 26 and 28 of the radius arm portion 14. As shown, the protractor portion 12 is marked with protractor indicia being configured along the outer edge 32 of the protractor portion 12. The protractor indicia include a series of lines 30 or tic marks in five degree increments. Furthermore, the protractor indicia include numeric indicia configured just below these lines 30 every fifteen degrees so that the protractor bears degree markings from fifteen degrees to one hundred sixty-five degrees, with the unmarked zero degree and one hundred eighty degree positions at the bottom edge 34 of the protractor portion 12. A protruding pointer or spur 39 is provided along the outer edge 32 of the protractor portion 12 proximate the ninety degree protractor indicia marking. As shown, two complementary series of protractor indicia may be provided, so that the user can measure angles beginning at zero degree or at one hundred eighty degrees from either one of the corners 36 and 38 of the protractor portion 12.

An integral radius arm portion 14 extends distally from the bottom edge 34 of the protractor portion 12. In the illustrated embodiment, the radius arm portion 14 is approximately seventeen inches in length so that a user can draw circles having diameters in the range of about two inches to about thirty four inches by moving the adjustable radius indicator 18 along radius arm portion 14. In other embodiments the radius arm portion 14 may be shorter or longer as desired. As shown, a series of metric system markings appears along the first lateral edge 26 of the radius arm portion 14 while a series of English system markings appears along the second lateral edge 28 of the radius arm portion 14. Alternatively, the radius arm portion 14 may be configured otherwise such that the first and second lateral edges 26, 28 may have the same markings or no markings at all. Additionally, although not shown, on the distal edge of the radius arm portion 14, at its center, a protruding pointer or spur (not shown) may be provided (directly opposite spur 39 of the protractor portion 12) to assist the user in aligning the tool 10 with any straight line on a surface.

As best shown in FIG. 1A, the securing member 20 may be a suction cup. The suction cup may include an upper portion rotatably coupled in the aperture 24 (FIG. 1), and a lower portion projecting from the lower surface of the tool 10. The upper portion of the suction cup may be configured to prevent accidental disconnection of the suction cup from the tool 10, for example, when removing the tool 10 from a surface. In an example, the upper portion of the suction cup may include a circumferential detent (not shown) that interference couples with a circumferential ledge (not shown) within the aperture 24 such that the suction cup may rotate within the aperture 24. The lower portion, as shown, is concave or generally bowl-shaped and is configured to have a generally circular perimeter, but, the lower portion may be configured otherwise, for example, elliptical-shaped, square-shaped, etc. as desired. The diameter of the lower portion of the suction cup may be about one inch, but the diameter may be larger or smaller as desired.

As can be appreciated from FIG. 3, the suction cup is made of a transparent or translucent material such as plastic or the like so that a vertex point (e.g., the intersection of two lines, as shown) on a drawing surface S can be sighted through the suction cup (as indicated by the dashed line) for drawing a circle about the vertex point. The suction cup may be clear or, alternatively, it may be colored to call attention to the vertex point. Although not illustrated, the lower portion of the suction cup may include radial lines extending from the center of the suction cup to its outer circumference. These lines may be visible from the top of the tool 10 as a user looks through the tool 10 and the suction cup, thereby enabling the user to both visualize the absolute center of the suction cup at the intersection of the lines, and to line up the center of the suction cup with a vertex point (e.g., a point of intersecting lines or curves) below the tool 10.

Although the foregoing-described embodiment of tool 10, wherein the securing member 20 is a suction cup, is advantageously used on a vertically-oriented drawing surface such as a chalkboard or dry-erase board, in another embodiment of the tool 10, the securing member 20 may be a magnet for releasably attaching the tool 10 to other metal or magnetic-type surfaces such as, for example, a magnetic dry-erase marker board known in the art. The magnet securing member may be configured with a toroidal or annular shape so that a vertex point on a drawing surface can be sighted through the magnet for drawing a circle about the vertex point. Alternatively, the magnet may be configured of iron oxide particles being in the range of about 2 to about 10 nanometers across such that the magnet is substantially transparent or translucent. In another alternative, the magnet may be configured of a silica-aerogel composite including $Nd_2Fe_{14}B$. Indeed, the magnet may be configured of other materials known in the art which have suitable magnetic and optical properties.

Figure 4:
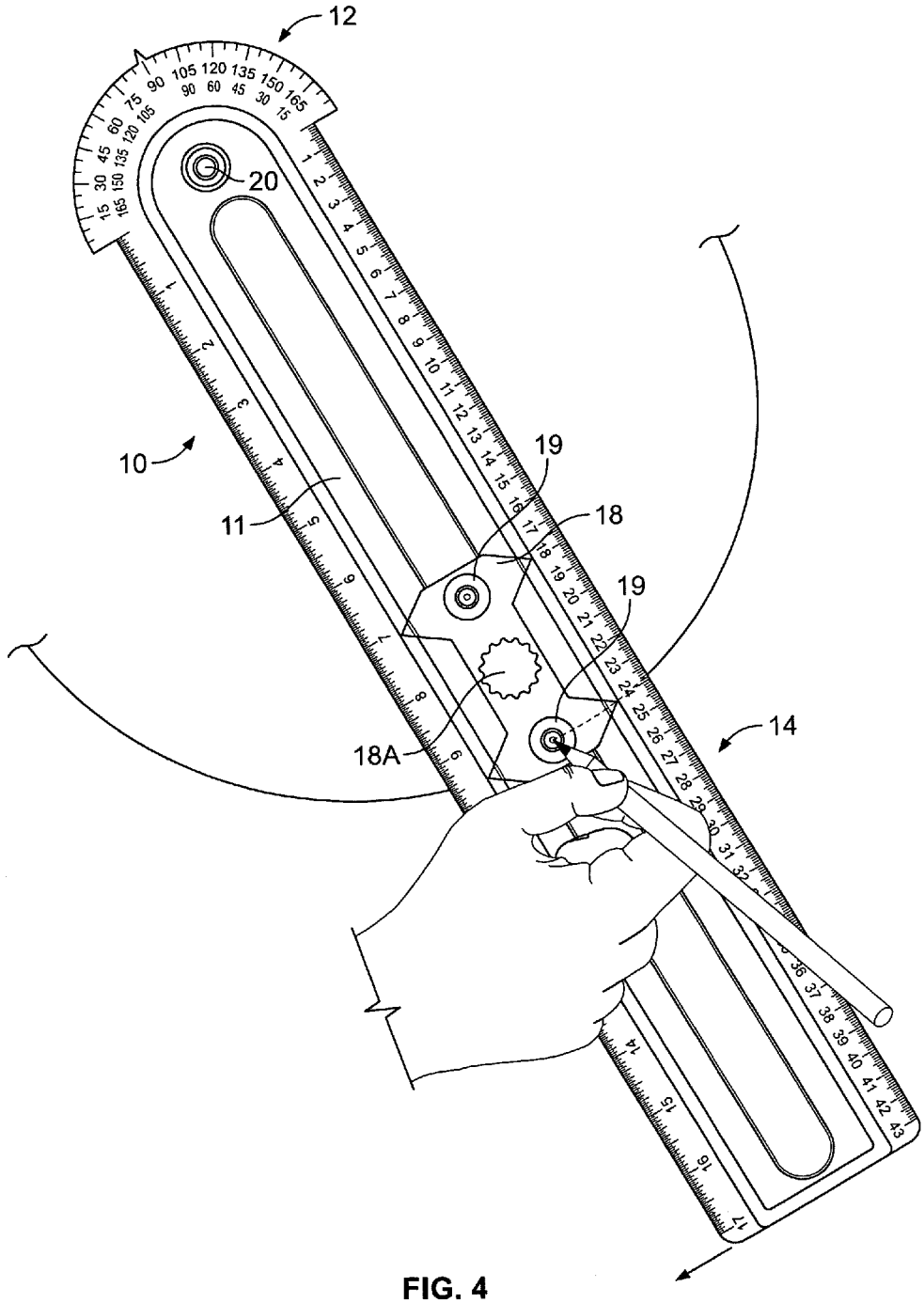
FIG. 4 illustrates the embodiment of FIG. 1 being used one-handed to draw a circle on a vertical drawing surface.

As further shown in FIG. 3, to prepare the tool 10 for use on a surface, first the user positions the tool 10 for attachment by sighting (as indicated by the dashed line) the vertex point on the surface through the securing member 20. The user then presses the securing member 20 to the surface thereby releasably attaching the tool 10 to the surface. After the user has attached the tool 10, one example use of the tool 10 is illustrated in FIG. 4. In the illustrated example, the tool 10 has been attached to a vertical drawing surface S such as a chalkboard or dry-erase board. In preparation to draw a circle or arc with the tool 10, the user first adjusts the adjustable radius indicator 18 along the radius arm portion 14 to be a desired distance from the vertex point and securing member 20. Next, the user selects a marker, chalk, pencil, pen or other suitable writing implement relative to the drawing surface S. The user then inserts or removes the members 21 into the apertures 19 relative to the selected writing implement and the desired thickness of the arc, circle, etc. to be drawn. The user inserts the implement into the aperture 19 (with or without member 21) of the adjustable radius indicator 18. Finally, the user, for example, using one hand, substantially simultaneously presses the writing implement toward the surface and rotates the writing implement and the radius arm portion 14 about the securing member 20. The user needs only one hand to draw a circle with the tool 10 since the securing member 20 is securely attaching the tool 10 to the vertex point. In this way, the drawing tool 10 may be used to draw an infinite number of coaxial, perfect circles. Further, by moving the securing member 20 from one point to another on the surface, the user may draw lines, measure distances and angles, construct angles and produce a plurality of geometric constructions and patterns.

Figure 5:
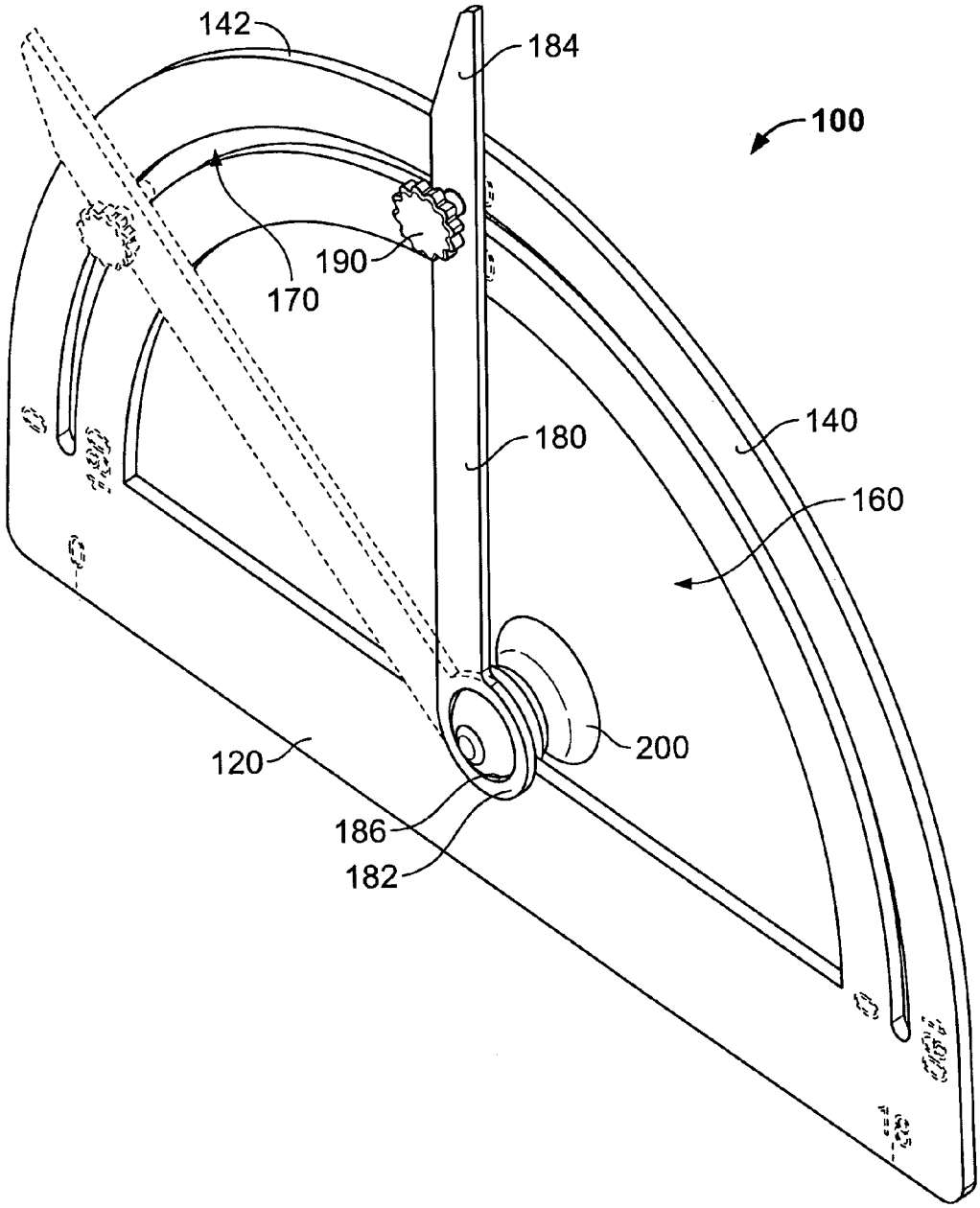
FIG. 5 illustrates a front perspective view of another embodiment of a multi-purpose drawing tool.

Referring now to FIG. 5, another embodiment of the multipurpose drawing tool is provided. As shown in FIG. 5, the multipurpose drawing tool may be an improved protractor 100. Protractor 100 as shown includes a generally semicircular body 110 with a straightedge portion 120 and a semicircular portion 140 that extends between the ends of the straightedge portion 120. Straightedge portion 120 may include ruler-type, distance-measuring indicia for facilitating measuring and/or drawing lines with the straightedge portion 120. In one example, the straightedge portion 120 may comprise distance-measuring indicia including one or more of the English and metric system indicia shown in FIG. 1. Semicircular portion 140 may include protractor-type angle indicia. In one example, the angle indicia include a series of lines or tic marks in five degree increments and corresponding numeric indicia configured just below these lines every fifteen degrees so that the semicircular portion 140 bears degree markings from zero degrees to one hundred eighty degrees. As shown, the semicircular portion 140 extends between the respective ends of straightedge portion 120 to define a semi-circular open area or space 160 therebetween. Furthermore, the semicircular portion 140 includes a semicircular, arcuate aperture 170 between the space 160 and the outer perimeter 142 of the semicircular portion 140.

As further shown in FIG. 5, the protractor 100 includes an arm 180 that is rotatable relative to the semicircular body 110 so that a user can measure and construct angles and arcs. The arm 180 includes a first end 182 that is pivotally mounted to a center portion of the straightedge portion 120, and a second end 184 that extends past the outer perimeter 142 of the semicircular portion 140. Intermediate the first and second ends 182, 184, the arm 180 includes an adjustment knob 190. A user may turn the adjustment knob 190 to tighten or loosen a clamp mechanism (not shown) so that the arm 180 may be oriented in a desired angular orientation relative to the straightedge portion 120. At the first end 182, the arm 180 is pivotally mounted to the straightedge portion 120 by a securing member 200, which may be a suction cup for releasably attaching the protractor 100 to a surface, for example a vertically-oriented surface S (FIG. 3) such as a dry-erase marker board (also known in the art as a "whiteboard") or a chalkboard (also known in the art as a "blackboard"). Although the securing member 200 may be particularly advantageous for releasably attaching the protractor 100 to vertically-oriented surfaces, the securing member 200 is not limited to such use and may be used to releasably attach the protractor 100 to horizontal surfaces and other slanted or angled surfaces. Furthermore, although the illustrated embodiment of the protractor 100 is shown with the securing member 200 being a suction cup, the securing member 200 may alternatively be a magnet.

As shown in FIG. 5, the securing member 200 may be a suction cup. The suction cup may include an upper portion rotatably coupled in an aperture 186 configured in the first end 182 of the arm 180, and a lower portion projecting from the lower surface of the protractor 100. The upper portion of the suction cup may be configured to prevent accidental disconnection of the suction cup from the protractor 100, for example, when removing the protractor 100 from a surface. In an example, the upper portion of the suction cup may include a circumferential detent (not shown) that interference couples with a circumferential ledge (not shown) within the aperture 186 such that the suction cup may rotate within the aperture 186 and the arm 180 may rotate about the suction cup. The lower portion, as shown, is concave or generally bowl-shaped and is configured to have a generally circular perimeter, but, the lower portion may be configured otherwise, for example, elliptical-shaped, square-shaped, etc. as desired. The diameter of the lower portion of the suction cup may be about one inch, but the diameter may be larger or smaller as desired.

As can be appreciated from FIGS. 3 and 5, the suction cup is made of a transparent or translucent material such as plastic or the like so that a vertex point (e.g., the intersection of two lines, as shown) on a drawing surface S can be sighted through the suction cup for accurately positioning the protractor 100 to facilitate measuring or drawing an angle or arc. The suction cup may be clear or, alternatively, it may be colored to call attention to the center/vertex point of the angle or arc. Although not illustrated, the lower portion of the suction cup may include radial lines extending from the center of the suction cup to its outer circumference. These lines may be visible from the top of the protractor 100 as a user looks through the protractor 100 and the suction cup, thereby enabling the user to both visualize the absolute center of the suction cup at the center/vertex point of the angle or arc, and to line up the center of the suction cup with a point below the protractor 100.

Although the foregoing-described protractor 100, wherein the securing member 200 is a suction cup, is advantageously used on a vertically-oriented drawing surface such as a chalkboard or dry-erase board, in another embodiment of the protractor 100, the securing member 200 may be a magnet for releasably attaching the protractor 100 to other metal or magnetic-type surfaces such as, for example, a magnetic dry-erase marker board known in the art. The magnet securing member may be configured with a toroidal or annular shape so that a vertex point on a drawing surface can be sighted through the magnet for drawing or measuring angles and arcs relative to the vertex point. Alternatively, the magnet may be configured of iron oxide particles being in the range of about 2 to about 10 nanometers across such that the magnet is substantially transparent or translucent. In another alternative, the magnet may be configured of a silica-aerogel composite including $Nd_2Fe_{14}B$. Indeed, the magnet may be configured of other materials known in the art which have suitable magnetic and optical properties.

The use of the terms "a" and "an" and "the" and similar referents in the context of describing the invention (especially in the context of the following claims) are to be construed to cover both the singular and the plural, unless otherwise indicated herein or clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Various embodiments of this invention are described herein. It should be understood that the illustrated embodiments are exemplary only, and should not be taken as limiting the scope of the invention.

What is claimed is:

1. An improved drawing tool including a protractor portion, an elongated radius arm portion extending from the protractor portion and having an opening for receiving a writing instrument for pressing through the opening onto a drawing surface, and an aperture bridging an intersection of the protractor portion and the elongated radius arm portion, wherein the improvement comprises a magnet rotatably mounted in the aperture and operable to releasably attach the drawing tool to a drawing surface, the magnet comprising a transparent or translucent silica material and a plurality of fine magnetic particles.

2. The improved drawing tool of claim 1 wherein the magnet has a generally toroidal or annular shape.

3. The improved drawing tool of claim 1 wherein the elongated radius arm portion includes:

an elongated rectangular cavity centered on a longitudinal axis of the elongated radius arm; and an adjustable radius indicator mounted in the elongated cavity, the adjustable radius indicator being slidable along substantially an entire length of the elongated radius arm portion.

4. The improved drawing tool of claim 1 further comprising a member including a hole, the member being removably insertable in the opening for receiving a writing instrument, wherein the hole confines a tip of the writing instrument on the drawing surface.

5. A drawing tool comprising:

an elongated body adapted to rest against a drawing surface, the elongated body including a generally rectangular cavity substantially centered on a longitudinal axis of the elongated body, and an aperture at an end of the generally rectangular cavity;

an adjustable radius indicator mounted in the generally rectangular cavity, the adjustable radius indicator including an opening for receiving the tip of a drawing instrument for pressing through the opening onto the drawing surface; and a transparent or translucent magnet rotatably mounted in the aperture to releasably attach the tool to the drawing surface, the magnet comprising a transparent or translucent silica material and a plurality of fine magnetic particles.

6. The drawing tool of claim 5 wherein the elongated body includes a protractor portion projecting from an end of the elongated body distal proximal the aperture.

7. The drawing tool of claim 5 wherein the magnet having has a generally toroidal or annular shape.

8. The drawing tool of claim 5 wherein the adjustable radius indicator is slidable along substantially an entire length of the elongated radius arm portion.

9. The drawing tool of claim 5 further comprising a member including a hole, the member being removably insertable in the opening for receiving a writing instrument, wherein the hole confines a tip of the writing instrument on the drawing surface.

10. An improved protractor including a straightedge portion, a protractor portion extending arcuately between ends of the straightedge portion, and an arm having a first end with an aperture, the arm being pivotally mounted at the first end to a center of the straightedge portion, wherein the improvement comprises a magnet rotatably mounted in the aperture and operable to releasably attach the protractor to a drawing surface, the magnet comprising a transparent or translucent silica material and a plurality of fine magnetic particles.

11. The improved protractor of claim 10 wherein the magnet has a generally toroidal or annular shape.

* * * * *